US005754151A

United States Patent [19]

Moon

[11] Patent Number: 5,754,151

[45] Date of Patent: May 19, 1998

[54] CIRCUIT FOR DRIVING A THIN FILM TRANSISTOR LIQUID CRYSTAL DISPLAY

[75] Inventor: Seung-hwan Moon, Seoul, Rep. of Korea

[73] Assignee: Samsung Electronics Co., Ltd., Kyungki-Do, Rep. of Korea

[21] Appl. No.: 600,110

[22] Filed: Feb. 12, 1996

[30] Foreign Application Priority Data

Feb. 11, 1995 [KR] Rep. of Korea ..... 2511/1995

[51] Int. Cl.[6] ..... G09G 3/36

[52] U.S. Cl. ..... 345/92; 345/87; 345/98

[58] Field of Search ..... 345/87, 90–94, 345/98–100, 205, 208; 349/41, 42

[56] References Cited

U.S. PATENT DOCUMENTS

| | | | |
|---|---|---|---|
| 5,315,396 | 5/1994 | Miyadera | 345/90 |
| 5,587,722 | 12/1996 | Suzuki et al. | 345/92 |
| 5,606,340 | 2/1997 | Suzuki et al. | 345/92 |

*Primary Examiner*—Richard H. Hjerpe
*Assistant Examiner*—Kent Chang
*Attorney, Agent, or Firm*—Cushman Darby & Cushman Intellectual Propert Group of Pillsbury Madison Sutro, LLP

[57] ABSTRACT

Described in this invention is a circuit for driving a thin film transistor liquid crystal display (TFT-LCD) which reduces the number of the analog switches and power consumption by omitting the large power consumption elements such as the operational amplifier and the push-pull amplifier.

4 Claims, 2 Drawing Sheets

CIRCUIT FOR DRIVING A THIN FILM TRANSISTOR LIQUID CRYSTAL DISPLAY

BACKGROUND OF THE INVENTION

The present invention relates to a circuit for driving a thin film transistor liquid crystal display (TFT-LCD), which more specifically generates a signal capable of driving a thin film transistor liquid crystal display with low-power consumption.

DESCRIPTION OF THE PRIOR ART

In these days, the technology of screen informations has been concentrated on the production of display devices. In particular, flat panel display devices have grown increasingly popular as substitutes for a cathod ray tubes and are now being produced on a commercial scale.

Liquid crystal displays, among the various types of the flat panel display devices, are particularly well matched to integrated circuits because of their thinness, low-weight, low-cost, and low-power consumption. Accordingly, liquid crystal displays have been widely applied to laptopcomputors, pocket computors, automobiles, and color televisions.

There have been generally known two methods of driving a liquid crystal display: one is an AC common driving method; another is a DC common driving method.

The typical AC common driving method is described below with reference to the appending drawings.

FIG. 1 is a waveform for driving a prior art TFT-LCD, FIG. 2 is a circuit block diagram for driving a prior art TFT-LCD and FIG. 3 shows a detailed circuit diagram of a prior art analog switch for a TFT-LCD.

As shown in FIG. 1, to drive the TFT-LCD, there are basically provided a common electrode voltage generating wave Vcom for generating a constant voltage (Vcom1–Vcom2) periodically, a gate-on voltage generating wave Vgh for generating an absolute constant voltage of Vgh1–Vgh2 which causes the TFT-LCD to be turned on, and a gate-off voltage generating wave Vg1 for generating an absolute constant voltage of VgL1–VgL2 which causes the TFT-LCD to be turned off.

To create such waveforms, it has been used a construction shown in FIG. 2, which is comprised of analog switches 1, 3 and 5 for generating a rectangular waveform in response to an analog switching signal POL; and buffers 2, 4 and 6 for amplifying power in response to the input rectangular waveform, so that the TFT-LCD starts to be operated.

The operation of such a constructed TFT-LCD is described below.

The operation of the TFT-LCD is begun with the application of power by a user.

The switching signal POL is then applied to the analog switches 1, 3 and 5, and the input analog switching signal POL is converted to a rectangular wave.

The rectangular waveform is outputted to the buffers 2, 4 and 6 and then amplified. Next, the amplified waveform is outputted as each waveform as a common electrode voltage generating waveform Vcom, a gate-on voltage generating waveform Vgh and a gate-off voltage generating waveform Vg1, each serving as the driving signal of the TFT-LCD.

The above-mentioned operation is described below in more detail with reference to FIG. 3.

In this figure, the switching signal POL is an inverse signal which causes the analog switches 1, 3 and 5 (FIG. 2) to be turned on or off, the voltages V1 and V2 are potentials inputted from the analog switches, each having a different level.

As shown in this figure, provided that the switching signal POL is at a high state, the buffer AS1 is turned on and the inverter AS2 is turned off, thereby outputting the voltage V1, whereas provided that the switching signal POL is at a low state, the buffer AS1 is turned off and the inverter AS2 is turned on, thereby outputting the voltage V2.

As a result, the analog switch generates a rectangular waveform having the voltages V1 and V2 in response to the analog switching signal POL.

In such an operation, the buffers 2, 4 and 6 (FIG. 2) each composed of the operational amplifier and the push-pull amplifier enable the power to be compensated, thereby generating the common electrode voltage generating waveform Vcom, the gate on voltage generating waveform Vgh and the gate-off voltage generating waveform Vg1.

However, many disadvantages can be generated from the prior art construction. Included among these are that power consumption of the entire circuits is large because the buffer and the switch are composed of large power consumption elements such as the operational amplifier and the push-pull amplifier, and that there generates a constant offset voltage of the operational amplifier to the power source and a lowered voltage between the base and the emitter of the push pull circuit, giving a difficulty to the generation of the rectangular wave of the power source voltage. Another disadvantage is that power consumption drastically increases because a higher voltage than a desired rectangular waveform is required.

SUMMARY OF THE INVENTION

In view of the above, it is an object of the present invention to provide a circuit for driving a thin film transistor liquid crystal display (TFT-LCD) capable of reducing power consumption and outputting power source voltage.

To achieve this object, according to a preferred embodiment of the present invention, a circuit is provided which comprises: an analog switch for carrying out the switching operation in response to a switching signal; a circuit connected to the analog switch for generating a common electrode voltage in response to the analog switching signal; a circuit connected to the analog switch for generating a gate-on voltage to turn on the thin film transistor by shifting the analog switching signal to a predetermined potential and converting the shifted signal; and a circuit connected to the analog switch for generating a gate-off voltage to turn off the thin film transistor in response to the analog switching signal.

DETAILED DESCRIPTION OF THE PREFERRED EMBODIMENTS

A preferred embodiment of the present invention is described with reference to the accompanying drawings.

Figure 1:
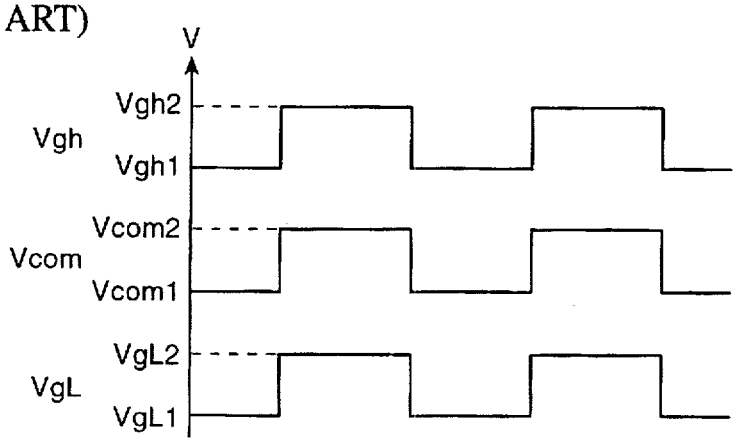
Fig. 1 (PRIOR ART)
FIG. 1 is a waveform for driving a prior art TFT-LCD.
Figure 2:
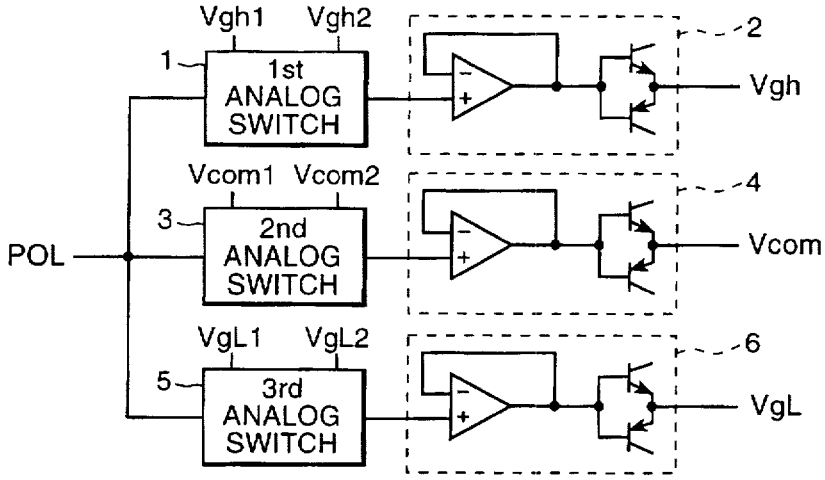
Fig. 2 (PRIOR ART)
FIG. 2 is a circuit block diagram for driving a prior art TFT-LCD.
Figure 3:
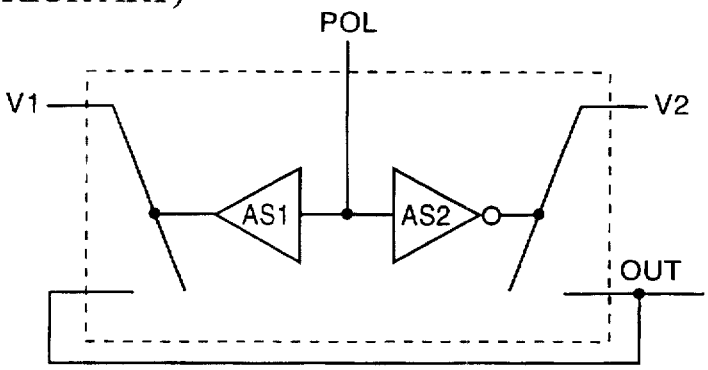
Fig. 3 (PRIOR ART)
FIG. 3 is a detailed circuit diagram a prior art analog switches.
Figure 4:
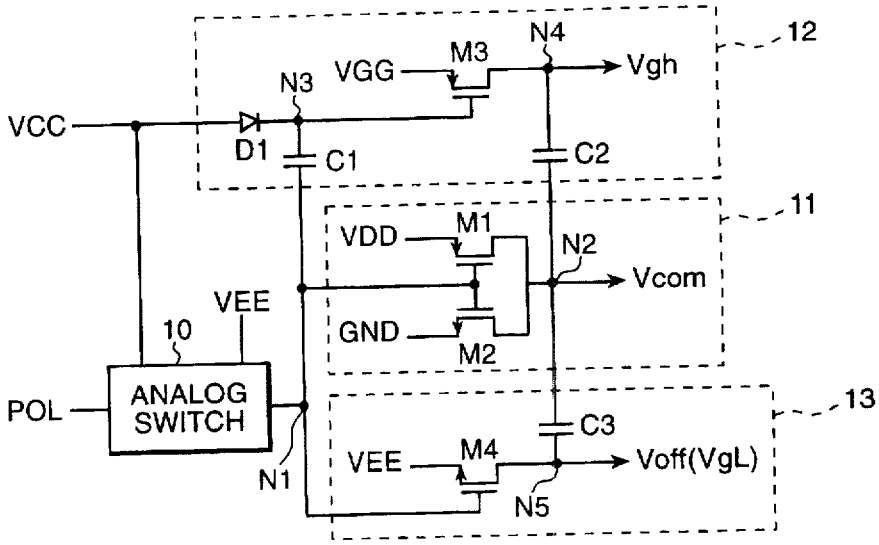
FIG. 4 is a circuit diagram for driving a TFT-LCD according to a preferred embodiment of the present invention.

As shown in FIG. 4, a circuit for driving a TFT-LCD, which is comprised of an analog switch 10 (of the type shown in FIG. 3) for carrying out the switching operation in response to a switching signal POL; a common electrode voltage generating circuit 11 connected to the analog switch 10 for generating a common electrode voltage in response to the analog switching signal POL; a gate-on voltage generating circuit 12 connected to the analog switch 10 for generating a gate-on voltage which causes a TFT to be turned on by shifting the analog switching signal to a constant potential and converting the shifted signal; and a gate-off voltage generating circuit 13 connected to the analog switch 10 for generating a gate-off voltage which causes the TFT to be turned off in response to the analog switching signal.

More detailed construction is described below with respect to the same figure.

The switching signal POL as the inverse signal is inputted to the analog switch 10.

The analog switch 10 is connected to gate terminals of a first MOS transistor M1 and a second MOS transistor M2 of the common electrode generating circuit 11, a first capacitor C1 of the gate-on voltage generating circuit 12, and a gate terminal of a fourth MOS transistor M4 of the gate-off voltage generating circuit 13.

The common electrode voltage generating circuit 11 is connected to a second capacitor C2 of the gate-on voltage generating circuit 12 and to a third capacitor C3 in the gate-off voltage generating circuit 12.

Further, the gate on voltage generating circuit 12 is constructed in such a manner that the anode of a first diode D1 is connected to a power source VCC and cathode is connected to the first capacitor C1 and a gate terminal of a third MOS transistor M3. A source terminal of the third MOS transistor M3 is connected to a power source VGG and a drain terminal of the third MOS transistor M3 is connected to the second capacitor C2.

The gate-off voltage generating circuit 13 is constructed in such a manner that a source terminal of the fourth MOS transistor M4 is connected to a power source VEE and a drain terminal of the fourth MOS transistor M4 is connected to the third capacitor C3.

The operation of the driving circuit of this invention is described below.

The analog switch 10 receives the switching signal POL and creates a rectangular waveform which causes the first, second and fourth MOS transistors M1, M2 and M4 to be turned on.

In such a operation, the voltages are given by
VGG>VCC>VDD>GND>VEE, and
VGG<VCC+(VCC−VEE)

In the output waveform of the analog switch 10, provided that the switching signal POL is low, the buffer AS1 shown in FIG. 3 is turned off and the inverter AS2 is turned on, whereby the reference voltage VEE is outputted. Whereas provided that the switching signal POL is high, the buffer AS1 is turned on and the inverter AS2 is turned off, whereby the voltage VCC is outputted.

Figure 5:
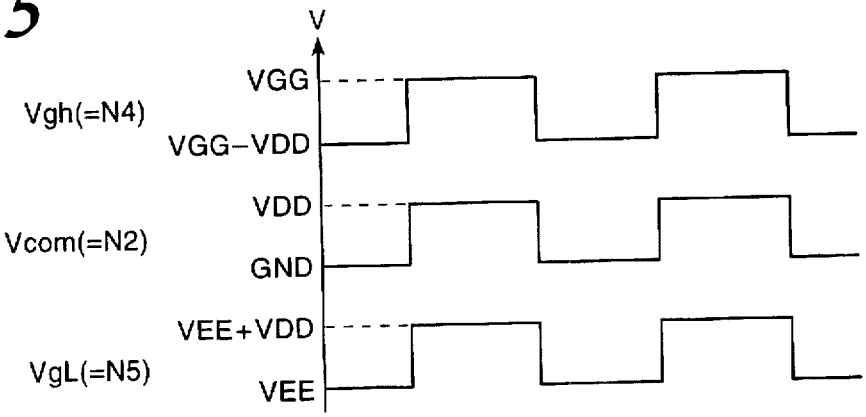
FIG. 5 shows each waveform for driving a TFT-LCD of a preferred embodiment of the present invention.

When the analog switch 10 outputs the voltage VEE, the first MOS transistor M1 of P-type of the common electrode generating circuit 11 is turned on and the voltage VDD is outputted from the drain of the first MOS transistor M1, whereas, when the analog switch 10 outputs the voltage VCC, the second MOS transistor M2 of N-type of the common electrode generating circuit 11 is turned on and the ground voltage GND which is connected to the source of the second MOS transistor M2 is outputted to the drain, thereby creating the common electrode voltage generating waveform Vcom as shown in FIG. 5.

Figure 6:
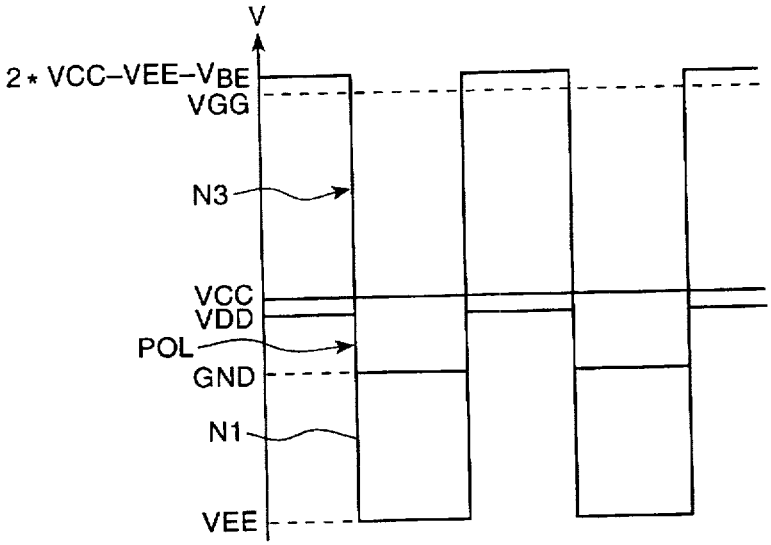
FIG. 6 shows waveform from each circuit for driving a TFT-LCD of a preferred embodiment of the present invention.

Differently from the above, the waveform at the first node N1 is level-shifted as much as the voltage VCC−VEE as shown in FIG. 6.

In detail, when the first node N1 outputs the voltage VEE, the first diode D1 is turned on and the third node N3 outputs the voltage $VCC-V_{EE}$, whereby the first capacitor C1 charges (VCC−VBE−VEE)*C1.

Next, when the first node N1 outputs the voltage VCC, the first diode D1 is turned off, the first capacitor C1 charges (VCC−VBE−VEE)*C1 and the third node N3 outputs VCC+VCC−VBE−VEE, thereby creating the common electrode voltage generating waveform Vcom as shown in FIG. 5.

Thus a formed waveform of the third node N3 turns on or off the third MOS transistor M3.

The third MOS transistor M3 is turned on when the third node N3 has the voltage VC, and thus the voltage VGG of the source is outputted to the drain.

As a result, the second capacitor C2 which is connected to the waveform Vcom charges C2*(VGG−VDD). This electric charge is maintained even though the third MOS transistor M3 is turned off, i.e., the third node N3 is at 2*VCC−VEE, so that the fourth node N4 is at VGG−VDD−GND and generates the voltage VGG−VDD.

The gate-on voltage generating waveform Vgh is created when the above-mentioned operation is repeated as shown in FIG. 5.

Whereas, when the first node N1 is at the level VCC, the fourth MOS transistor M4 of the gate-on voltage generating circuit 13 is turned on and the fifth node N5 shows the level VEE.

At this time, the third capacitor C3 charges C3*(VEE−GND) and the first node N1 shows the level VEE. Accordingly, the common electrode voltage generating waveform Vcom is at the level VDD when the fourth MOS transistor M4 is turned off, so that the fifth node N5 shows the level VEE+VDD.

The gate-off voltage generating waveform Vg1 is created when the above-mentioned operation is repeated as shown in FIG. 5.

As mentioned above, it is possible to obtain the improved driving circuit of the TFT-LCD which reduces power consumption by reducing the number of the analog switches and omitting the operational amplifier and the push-pull amplifier.

The resultant circuit has some advantages which are summarized below.

Firstly, power consumption is reduced drastically.

Secondly, good quality images can be obtained since the common electrode voltage generating waveform and the gate-on voltage generating waveform are the same.

Thirdly, the best characteristics of the display can be realized by obtaining a maximum possible driving ability of the TFT-LCD.

Fourthly, large productivity of this circuit is permitted because there is no additional external variable resistor for controlling level. In other words, the number of the elements is reduced, without the requirement of the control time.

What is claimed is:

1. A circuit for driving a thin film transistor liquid crystal display (TFT-LCD), which comprises:

an analog switch for carrying out the switching operation in response to a switching signal;

a circuit connected to the analog switch for generating a common electrode voltage in response to the analog switching signal;

a circuit connected to the analog switch for generating a gate-on voltage to turn on the thin film transistor by shifting the analog switching signal to a predetermined potential and converting the shifted signal; and a circuit connected to the analog switch for generating a gate off voltage to turn off the thin film transistor in response to the analog switching signal.

2. A circuit for driving a thin film transistor liquid crystal display of claim 1, in which the gate-on voltage generating circuit comprises:

a diode;

a first capacitor, connected to said diode, for receiving the signal from said diode;

a MOS transistor, connected to said diode, for receiving the signal from the said diode; and a second capacitor for receiving the signal from said MOS transistor, connected to said MOS transistor and the common electrode voltage generating circuit.

3. A circuit for driving a thin film transistor liquid crystal display of claim 1, in which a common electrode voltage generating circuit comprises:

a P-MOS transistor; and an N-MOS transistor juxtaposed with the P-MOS transistor.

4. A circuit for driving a thin film transistor liquid crystal display of claim 1, in which the gate-off voltage generating circuit comprises:

a MOS transistor;

a capacitor, for receiving the signal from said MOS transistor, connected to said MOS transistor and the common electrode voltage generating circuit.

* * * * *